US005170721A

United States Patent [19]

Troth et al.

[11] Patent Number: 5,170,721

[45] Date of Patent: Dec. 15, 1992

[54] ROLL CRADLE PALLET

[75] Inventors: William L. Troth, St. Charles; Alvin G. Bisch, Lemont, both of Ill.

[73] Assignee: Office Electronics, Inc., Itasca, Ill.

[21] Appl. No.: 829,632

[22] Filed: Feb. 3, 1992

[51] Int. Cl.[5] ..... B65D 19/00

[52] U.S. Cl. ..... 108/51.1; 206/386

[58] Field of Search ..... 108/51.1, 53.1, 55.1; 206/386

[56] References Cited

U.S. PATENT DOCUMENTS 3,091,348 5/1963 Neuhauser ..... 206/386

FOREIGN PATENT DOCUMENTS 1937205 4/1979 Fed. Rep. of Germany ..... 206/386

1262202 2/1972 United Kingdom ..... 108/55.1

*Primary Examiner*—Joseph Falk

*Assistant Examiner*—Gerald A. Anderson

*Attorney, Agent, or Firm*—Keil & Weinkauf

[57] ABSTRACT

A pallet for transporting and storing cylindrical articles whose major axes lie parallel to the support surface, comprising a deck with two integral side-walls and two end walls of trapezoidal cross-sectional shape, each of said end-walls having a surface sloping upwardly and outwardly of the axis of the article to provide for its support. At least one, or optionally both, of said end-walls are releasably detachable from the upper surface of the deck and attachable to the side of the deck so that the end-wall member serves as a ramp along whose sloping surface the cylindrical article may be rolled as it is loaded onto or unloaded from the pallet.

3 Claims, 1 Drawing Sheet

ROLL CRADLE PALLET

BACKGROUND AND SUMMARY OF THE INVENTION

The present invention relates to a pallet for supporting and transporting cylindrical objects. A special adaptation of the pallet is the provision of two detachable retaining end walls, or optionally one detachable end-wall, which after detachment from the upper surface of the pallet can be used as a ramp along which the cylindrical article may be rolled to facilitate removal of the article from the pallet.

It is a common practice in the material handling art to place articles on a pallet to reduce the manual handling of the article and to facilitate movement of the article in commerce by a lift truck or the like. Flat pallets, comprising a flat upper support surface with retaining walls extending therefrom are probably the most common type of pallet at the present time, and have provided an excellent means of transporting and storing many different types of articles. Previous attempts to provide pallets that may be used with cylindrical articles have, however, presented problems. If the pallet has a flat deck, a cylindrical article placed on the deck with its major axis parallel to the support surface, transfers its weight to a single line along the deck. Some cylindrical articles, for example, large rolls of paper or cloth, may be damaged by this type of weight transfer. Another problem with this type of pallet is that removal of heavy cylindrical articles from the pallet by hand can be hazardous to the operator if the articles must be lifted over the retaining walls of the pallet. Yet another problem with flat pallets is that cylindrical articles tend to roll across the support surface during transportation and may be damaged when coming into contact with the retaining walls. Such movement of the article also may cause undesirable instability of the pallet and, thus, of a vehicle by which the pallet may be transported. Blocks of materials, such as wood or polymer, placed between the upper support surface of the pallet and the base of the cylindrical article may be used as a wedge to keep the article from rolling during transport. The blocks may, however, cut into delicate material and cause damage thereto.

Accordingly, it is a primary object of this invention to provide a new and improved pallet which facilitates the loading and unloading of cylindrical articles thereby minimizing operator injury.

Still another object of this invention is to provide a pallet for rolls of material, such as paper and cloth, in which the pallet is designed to minimize damage to the material during storage and transport, and to eliminate excessive deformation of the delicate material due to transfer of its weight to the supporting structure of the pallet deck.

The invention is illustrated in the attached drawings described below. It is to be understood, however, that applicant's invention is not limited strictly to what is shown in the drawings.

DETAILED DESCRIPTION OF THE DRAWINGS

Figure 3:
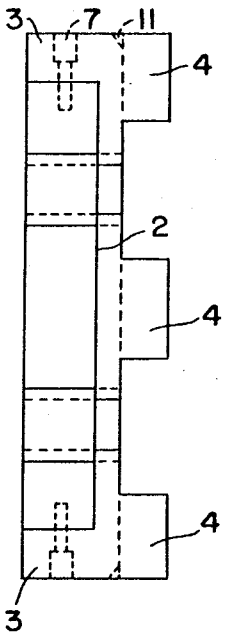
FIG. 3 is a side-elevational view of the pallet with the detachable end-wall member in the material transporting and pallet storage position.
Figure 1:
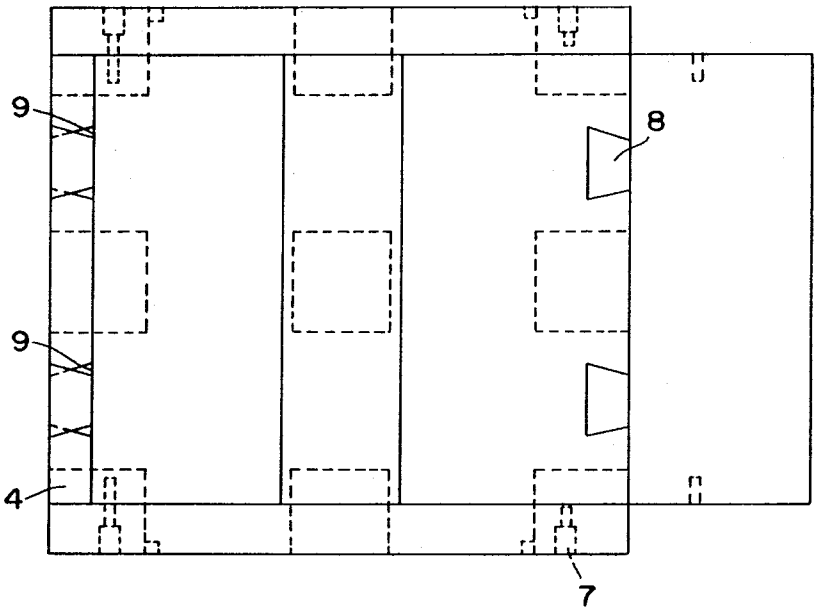
FIG. 1 is a plan view of a pallet embodying the invention, showing a detachable end-wall member in the ramp or loading position.
Figure 2:
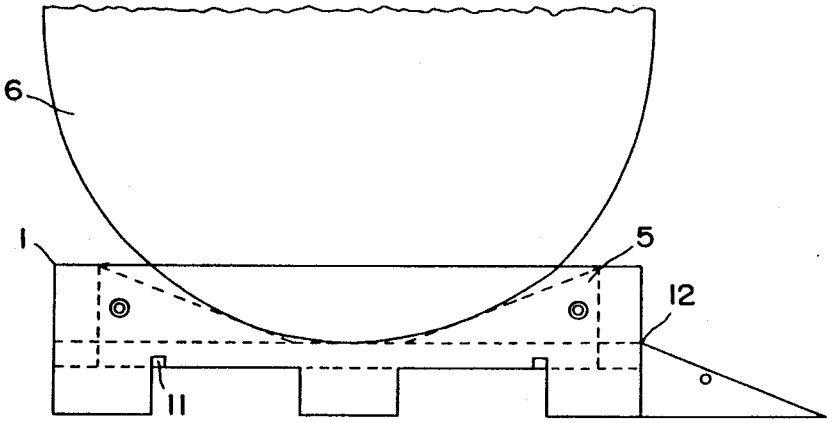
FIG. 2 is a front-elevational view of the pallet of FIG. 1., showing a detachable end-wall member in the ramp or loading position.

A roll cradle pallet for supporting objects is generally shown in FIGS. 1 through 3. The pallet (1) as illustrated, generally comprises a deck (2) with two integral retaining side-walls (3) extending above the deck on opposite sides. Support posts (4), integral with the deck, raise the deck above ground level and extend below the deck at its four corners, at its center, and at the midpoint of each of the sides of the deck. The arrangement of the support posts (4) beneath the deck is intended to allow four-sided access beneath the pallet by a lifting apparatus, such as a lift truck, or the like.

The end-wall members (5) serve as a support for the cylindrical article (6) in the transportation position (FIGS. 1 and 2, Note A), and at least one end-wall member (5) being detachable from the deck (2), to serve as a ramp along which the cylindrical articles can be rolled during loading and unloading operations (FIGS. 1 and 2, Note B, wherein one detachable end-wall member is shown in the ramp position). In the article transporting position, a detachable end-wall member (5) is secured to the deck by screws or the like, inserted through mutually corresponding threaded inserts (7) in the integral side-wall (3) and end-wall members (5). An end-wall member that is intended to be detachable from the deck (2) includes two "dove-tailed" protrusions (8), or the like, that are complementary to two "dovetailed" notches (9), or the like, in the deck (2) of the pallet at the side-wall end. Thus, when the pallet is in the ramp position, the detachable end-wall member (5) is secured to the deck (2) by unison of the dovetail protrusions (8), or the like, of the detachable end-wall member (5) with complementary dovetail notches (9), or the like, of the deck (2). The dual function of the detachable end-wall a support for the article and as a ramp for loading and unloading the article is a critical aspect of the invention and is described more specifically below.

The trapezoidal shape of each of the end-wall members (5) provides sloped surfaces (10) upon which the cylindrical article (6) rests along its length. The article (6) is tangentially supported by each sloped surface (10). Two points of support for circular cross-sections of a cylindrical article are necessarily provided by the sloped surface (10) of each end-wall member (5) if the transverse dimensions separating sloped surfaces (10) is less than the diameter of the cylindrical article (6). Basic trigonometric and geometric relationships may be used to ascertain the cross-section and angle of slope of the sloped surface (10) for two points of support for cross-sections of a cylindrical article of a given diameter. After defining the configuration of the cross-section of end-wall members, one skilled in the art may easily determine the angle of the sloped surface (10) in relation to the deck of the pallet (2) which will provide support for a cylindrical article of a given diameter by the sloped surfaces and the deck.

The deck (2) is provided with notches (11), allowing the cylindrical article (6) to be secured to the pallet by tying means such as steel or fabric straps, or the like., which are guided through the notches (11).

When removal of the cylindrical article (6) from the pallet is desired, the detachable end-wall member (5) is removed from the deck (2) after retraction of securing screws, or the like, from the threaded inserts (7) in both sides of the integral side-walls (3). After detachment of the end-wall member from the deck, the "dovetailed" protrusions (8), or the like, of the end-wall member (5) are united with the complementary "dovetailed" notches (9), or the like, of the deck (2) so that the horizontal surface of the deck (2) is level with the top of the slope so formed between side of the pallet (12) and the ground. Such an arrangement between the pallet and end-wall member allows securement of the deck to the end-wall member (5) in the ramp position. The arrangement also allows the cylindrical article (6) to be rolled across the deck of the pallet and down the ramp formed by the sloping side (10) of the detached end-wall member, to the ground. The arrangement further allows a cylindrical article to be loaded onto the pallet by rolling the article up the ramp formed by the sloping side (10) of the detached end-wall member, to the deck (2) of the pallet.

If desired, the pallet may be constructed with two detachable end-wall members, allowing the cylindrical article (6) to be unloaded, or loaded, from either side of the pallet.

Though the various parts of the pallet may be made of any suitable material, preferably a polymer such as high density polyethylene (HDPE) is used.

It will be apparent to those skilled in the art that various modifications and variations could be made in the present pallet without departing from the scope or spirit of the invention. For example, it will be obvious to those skilled in the art that the dimensions of the pallet may be varied to store and transport a plurality of cylindrical articles whose axes are disposed in a substantially horizontal plane. It will also be obvious to those skilled in the art that a detachable end-wall can be secured to the deck of the pallet in the transporting position by means other than that specifically described herein.

We claim:

1. A pallet for storing and transporting cylindrical articles with the axis of the article disposed in a substantially horizontal plane, said pallet comprising: a deck having two integral side-walls extending above the surface of the deck, two end-walls having a surface sloping upwardly and outwardly of the axis of the article for supporting the article and preventing lateral movement of the article, each of said end-walls being in such a spaced parallel relationship to permit the cylindrical article to receive support from said sloped surfaces and said pallet deck, or from said sloped surfaces alone, at least one of said end-walls being releasably detachable from said deck and reattachable thereto so that said end-wall member serves as a ramp along whose sloped surface the cylindrical article is rolled when it is loaded onto or unloaded from the pallet.

2. The pallet of claim 1 wherein both of said end-wall members are releasably detachable and serve as ramps along whose sloped surface the cylindrical article is rolled when it is loaded onto or unloaded from the pallet.

3. The pallet of claim 1 wherein said end-walls are in such a spaced parallel relationship to permit the cylindrical article to receive support only from said sloped surfaces.

* * * * *